US006971543B2

(12) United States Patent
Halliburton et al.

(10) Patent No.: US 6,971,543 B2
(45) Date of Patent: Dec. 6, 2005

(54) ROTATING VEND MECHANISM

(75) Inventors: Ronald D. Halliburton, Delray Beach, FL (US); Steve Corso, Lake Worth, FL (US)

(73) Assignee: Benchmark Entertainment LLC, Hypoluxo, FL (US)

( * ) Notice: Subject to any disclaimer, the term of this patent is extended or adjusted under 35 U.S.C. 154(b) by 77 days.

(21) Appl. No.: 10/624,887

(22) Filed: Jul. 23, 2003

(65) Prior Publication Data

US 2004/0195257 A1 Oct. 7, 2004

Related U.S. Application Data

(60) Provisional application No. 60/397,608, filed on Jul. 23, 2002.

(51) Int. Cl.[7] ..... G07F 11/00

(52) U.S. Cl. ..... 221/75; 221/79; 221/120; 221/121; 221/133

(58) Field of Search ..... 221/75, 76, 79, 221/81, 119, 120, 121, 122, 123, 130, 132, 221/133

(56) References Cited

U.S. PATENT DOCUMENTS

| | | | | |
|---|---|---|---|---|
| 3,104,028 | A * | 9/1963 | Brown | 221/86 |
| 3,248,005 | A * | 4/1966 | Joschko | 221/13 |
| 3,294,281 | A * | 12/1966 | Schlaf | 221/9 |
| 4,638,922 | A * | 1/1987 | Stoltz | 221/75 |
| 4,687,119 | A * | 8/1987 | Juillet | 221/101 |
| 5,485,939 | A * | 1/1996 | Tucker | 221/86 |
| 5,897,022 | A | 4/1999 | Mann | |
| 6,056,151 | A | 5/2000 | Peery | |
| 6,340,094 | B1 * | 1/2002 | Kawamura | 221/79 |

* cited by examiner

*Primary Examiner*—David H Bollinger
(74) *Attorney, Agent, or Firm*—Andrew C. Aitken; Venable LLP

(57) ABSTRACT

A vend mechanism for transferring articles, or prizes, to a receiving area of a vending machine accessible from outside the machine, including an amusement game machine, has a plurality of conveyors arranged radially on each of a plurality of spaced plates. A first drive mechanism is provided to rotate an assembly of the plates so that a selected column of conveyors is in alignment with the receiving area and, for each plate, a second drive mechanism is provided to operate the conveyor that is in the transferring orientation so that an article, or prize, on the conveyor is transferred to the receiving area.

17 Claims, 13 Drawing Sheets

ROTATING VEND MECHANISM

CROSS-REFERENCE TO RELATED APPLICATION

The applicants claim the benefit of the filing date of provisional U.S. Application No. 60/397,608, filed on Jul. 23, 2002.

BACKGROUND OF THE INVENTION

The present invention relates to a vend mechanism and, more particularly, a vend mechanism suited for use for an amusement game.

SUMMARY OF THE INVENTION

By the present invention, a vend mechanism for transferring articles, or prizes, to a receiving area of a vending machine, including an amusement game machine, has at least one conveyor for transferring the articles to the receiving area and an arrangement for moving the conveyor to an orientation in which operation of the conveyor transfers one of the articles to the receiving area. The receiving area is accessible from outside the machine.

In preferred embodiments, a plurality of conveyors is arranged on each of a plurality of plates spaced from one another in a direction perpendicular to the plates. The conveyors on each plate are arranged radially, with angular spacing between adjacent conveyors. A structure, for example, a plurality of threaded rods and nuts, is used to fix the plates in an arrangement spaced from one another, and a drive mechanism is provided to rotate the assembly of plates and rods so that a selected column of conveyors is in alignment with the receiving area. For each plate, a drive mechanism is provided to operate the conveyor in the transferring orientation so that an article, or prize, on the conveyor is transferred to the receiving area. The level of success achieved by a player of the game determines whether any vending is enabled and, if so, provides enablement to the drives associated with conveyors containing prizes commensurate with the level of success achieved.

DETAILED DESCRIPTION OF THE INVENTION

Figure 1:
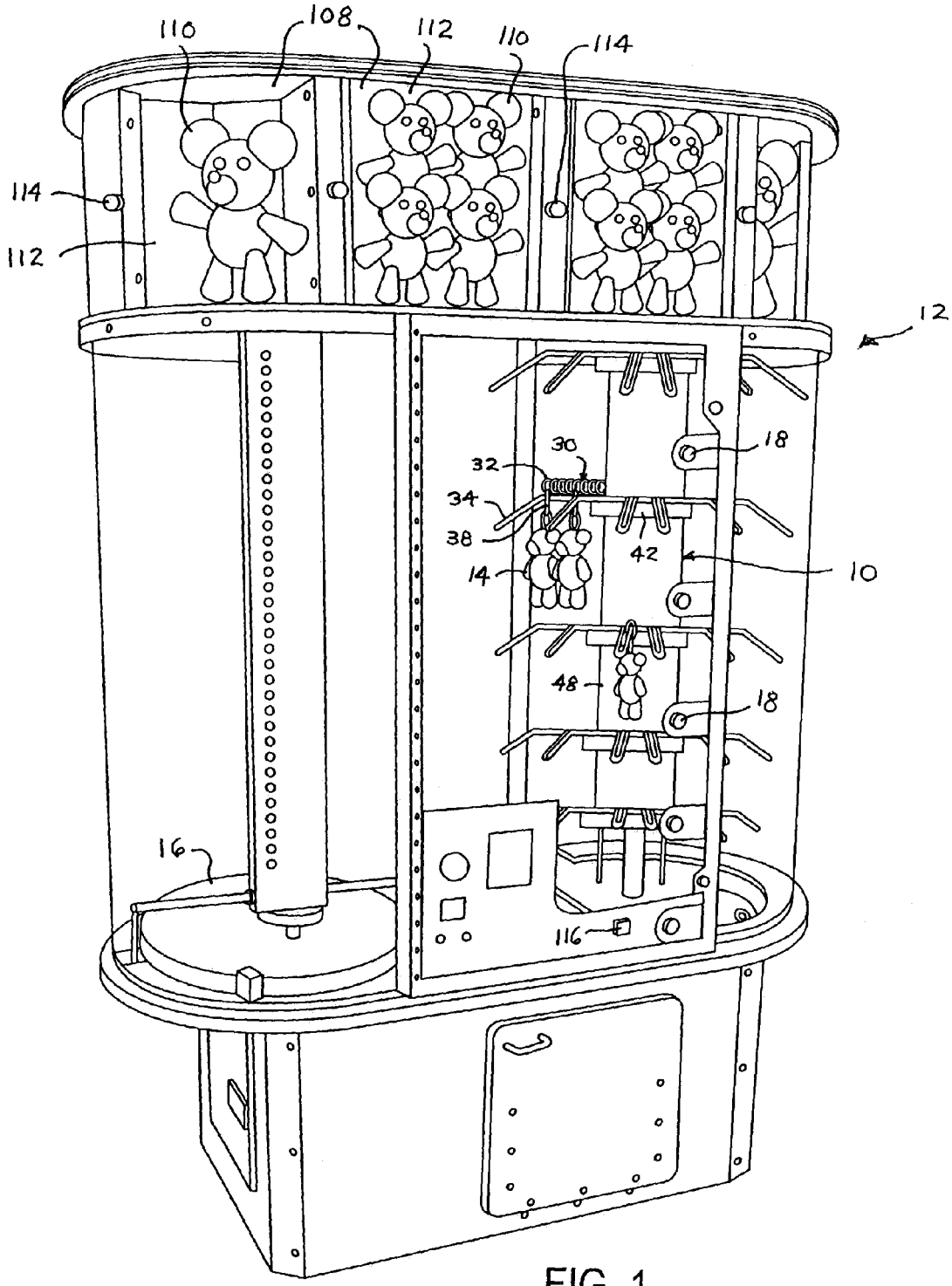
FIG. 1 is an isometric view of a vending machine employing a rotating vend mechanism according to the present invention, with some parts omitted.

As can be seen from FIG. 1, a vend mechanism according to the present invention, which is designated generally by the reference numeral 10, is shown positioned in a cabinet of an amusement game machine 12 for transferring articles 14, or prizes, to an area of the machine which is accessible from the exterior of the machine. In the illustrated embodiment, the vend mechanism 10 is positioned on the right side of the machine 12, and a game mechanism 16 is positioned on the left side of the machine. The vend mechanism 10 can be used with a large variety of game mechanisms.

Depending on the level of success achieved by a player, either no prize is awarded or a prize of one of various predetermined values is awarded. If a prize is to be awarded, the game mechanism 16 sends an electrical signal appropriate for controlling the vend mechanism 10 to transfer to the area of the machine accessible from the exterior a prize of a value commensurate with the level of success achieved. In the illustrated embodiment, if a prize is to be awarded, an electrical control mechanism associated with, for example, one of the buttons 18, each associated with articles on a certain level of the vend mechanism, is energized, so that the player can push the button to vend a prize from the level.

The illustrated game mechanism 16 is shown and described in greater detail in a copending U.S. patent application Ser. No. 10/152,571, filed on May 23, 2002, which is incorporated herein by reference. Generally, the game mechanism 16 disclosed in the copending application involves a game in which a coin is released from a coin mechanism at a pre-selected time and is then introduced to a rotating wheel. The coin moves with the rotation of the wheel until it engages a stationary coin guide positioned just above the surface of the wheel. Upon that engagement, rotational movement of the coin is stopped, and the coin begins to roll outwardly along an edge of the coin guide toward target positions located at angularly spaced locations on the wheel. Coins from the coin guide to successfully intersect or overlap a target position are detected by a coin detector and a prize is provided to the player.

The influence of skill on the outcome of the game mechanism disclosed in Ser. No. 10/152,571 can be reduced by using in connection with the coin mechanism disclosed therein a regulator that temporarily holds a coin inserted by a player into the coin mechanism before it releases the coin for movement into the game area. Thus, the coin inserted by the player can be held temporarily and then released for movement into the game area. As another alternative, the coin inserted by the player can be diverted from the game area by the coin mechanism and, instead, a different coin, for example, a token, can be released for movement into the game area. The vend mechanism 10 can also be used independently of any game mechanism, in a vending machine having controls for a customer to select a desired article.

Figure 2:
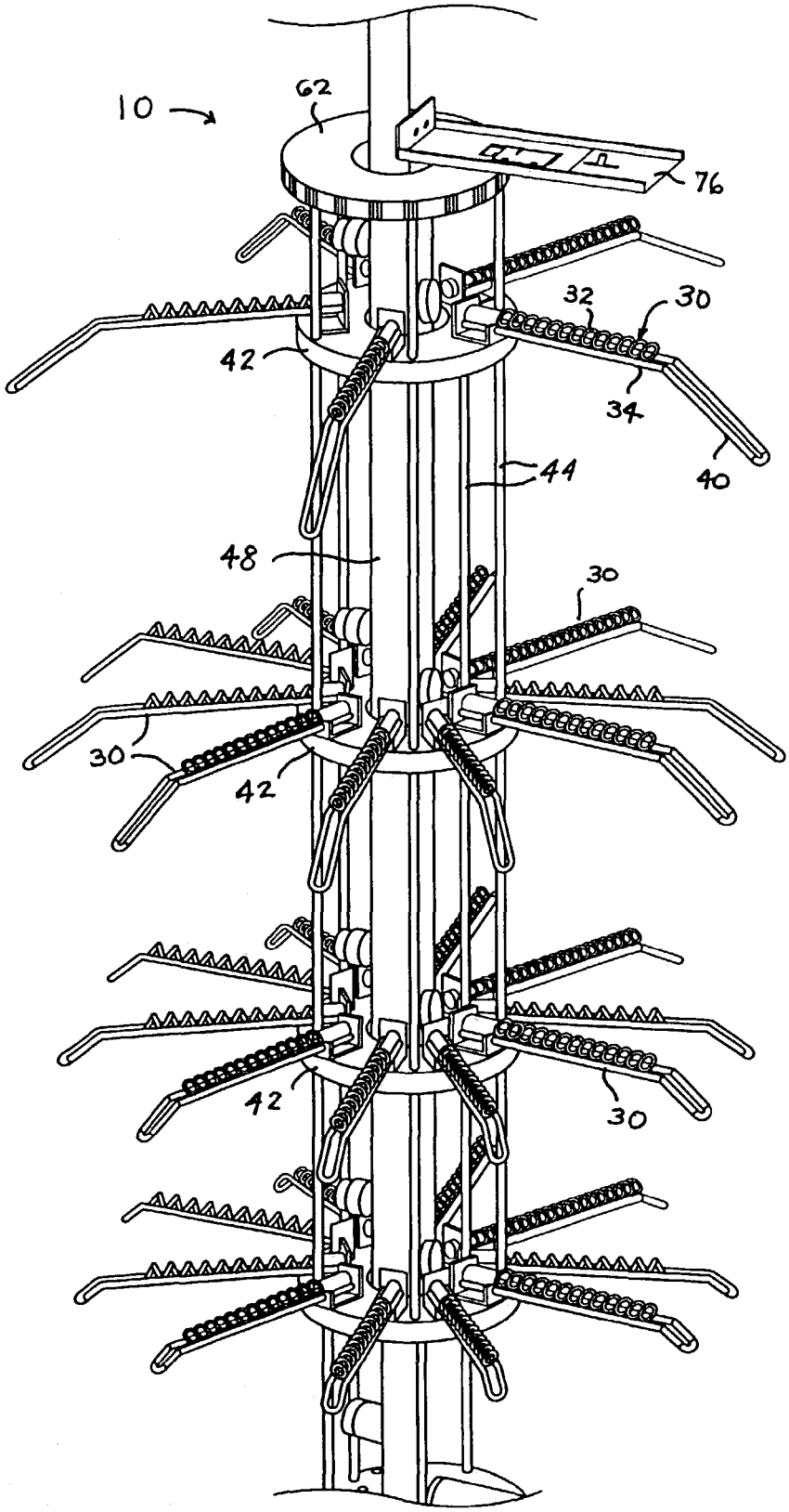
FIG. 2 is an isometric view of a vend mechanism according to the present invention.

As can be appreciated from FIGS. 1 and 2, at least one conveyor 30 for transferring the articles 14 to the receiving area defines a longitudinal axis, and a conveyor moving arrangement is provided to move the conveyor to an article-transferring orientation by moving the conveyor through an angle about an axis transverse to the longitudinal axis of the conveyor.

Figure 5:
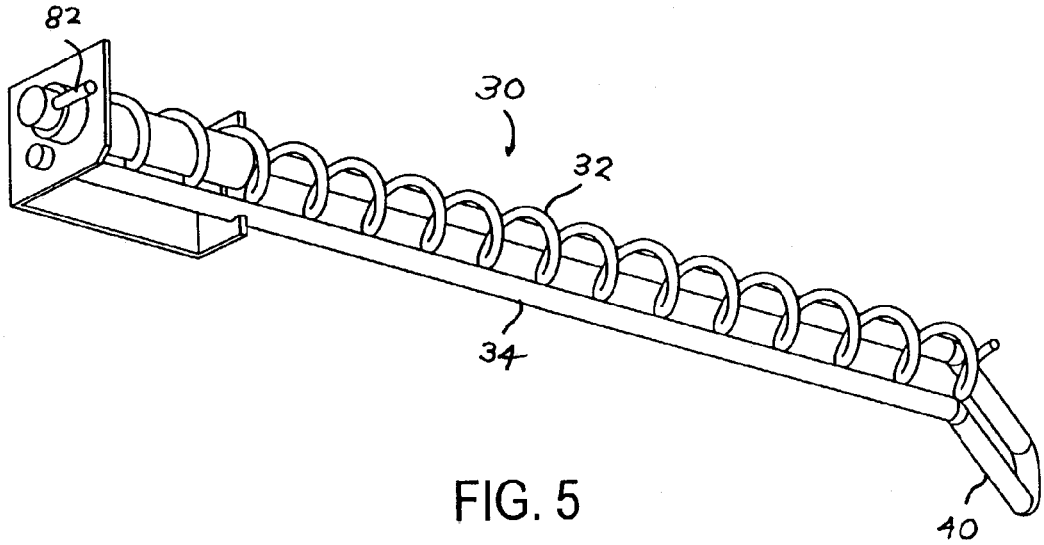
FIG. 5 is an enlarged isometric view of a conveyor of the vend mechanism of FIG. 2.

As can be seen from FIGS. 1 and 2, each conveyor 30 includes a helical element 32, or merchandise screw, rotatable about a rotational axis parallel to the longitudinal axis of the conveyor and an elongate merchandise support element 34, such as a rod, to support the articles. As can be seen from FIG. 3, the vend mechanism 10 further comprises a conveyor operator 36 for rotating the helical element about the rotational axis. The articles or prizes, such as stuffed animals, are supported between convolutions of the helical element 32 by, for example, a hook or loop 38 attached to each article and extending over the support element 34 and through the helical element 32, between adjacent convolutions. Thus, each helical element 32 can accommodate a plurality of articles 14. When the helical element 32 rotates, it screws an article 14 to a near end of a downwardly sloping portion 40 (FIG. 5) of the support element 34. The article slides down and over the far end of the downwardly sloping portion 40.

The conveyor operator 36 rotates the helical element 32 through an angle at which only one of the articles 14 is transferred to the receiving area. For example, during one operation, the conveyor operator 36 can operate the helical element 32 through an angle of 720°, that is, two full rotations, which, depending on the spacing of the articles 14, is sufficient to move one article but no other articles off the end of the conveyor 30. Of course, many other spacings between adjacent articles 14 on the conveyor 30 and many other degrees of rotation can be used in connection with the invention.

In the illustrated embodiment, a plurality of the conveyors 30 is provided, and the conveyor moving arrangement in response, for example, to an electrical signal, moves a selected conveyor 30 to a transferring orientation in which operation of the selected conveyor transfers one of the articles 14 to the receiving area of the vending machine 12. A plurality of the conveyors 30 is supported on a conveyor support plate 42, in a conveyor plane, and, in fact, in the illustrated embodiment, there are a plurality of conveyor support plates 42 in conveyor planes spaced from one another, each containing a plurality of the conveyors 30.

As can be appreciated from FIGS. 1 and 2, each of the conveyors 30 has a length determined by the length of the merchandise support element 34, the length of the conveyors lying on the top conveyor support plate 42 being the greatest, with the length of the conveyors of each lower conveyor support plate being incrementally smaller than the conveyors of the conveyor support plane immediately above it. This enables articles falling from the upper conveyors 30 to fall past the ends of the lower conveyors and thereby reach the receiving area. In the illustrated embodiment, the conveyors 30 of each conveyor support plate 42 are in vertical alignment with one another. If preferred, the orientations of the conveyors 30 of adjacent conveyor support plates 42 can be offset from one another, so that the conveyors of each conveyor support plate are in vertical alignment with the spaces between conveyors in the conveyor support plate immediately below them.

Figure 8:
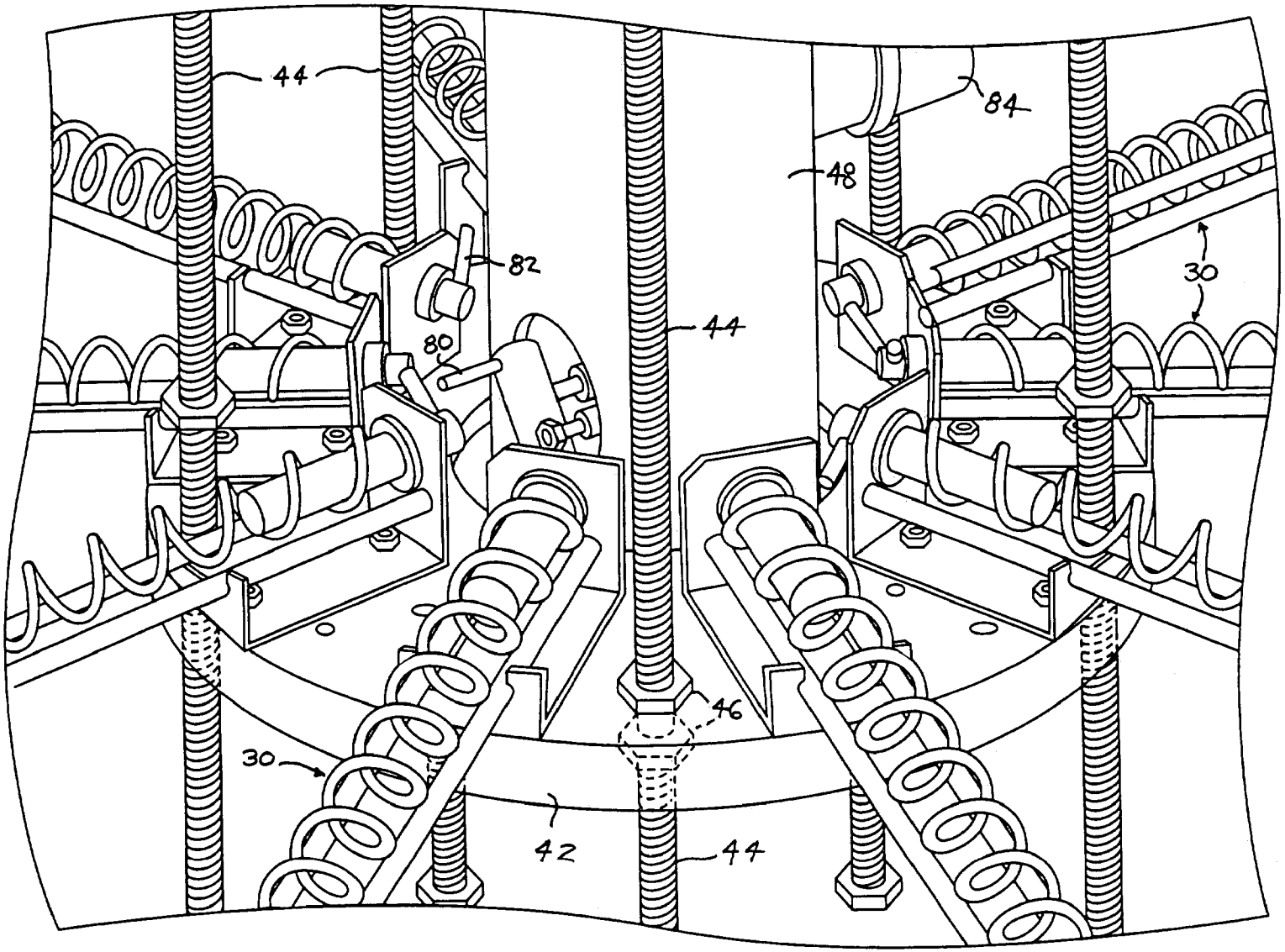
FIG. 8 is an enlarged view of a portion of the vending mechanism of FIG. 2, showing a conveyor plate mounted on threaded rods and a drive element out of engagement from the conveyors.

As can been seen from FIG. 8, the conveyor moving arrangement includes a plurality of threaded rods 44 perpendicular to the conveyor support plates 42, each threaded rod extending the entire length of the conveyor moving arrangement. Nuts 46 are provided at appropriate positions along the threaded rods to secure the conveyor support plates 42 in position. The conveyor support plates 42 contain a number of apertures spaced near the circumference of the support plates for receiving the threaded rods 44. One of the nuts 46 on each threaded rod 44 engages an underside of one of the conveyor support plates 42 to hold the conveyor support plate above the bottom of the cabinet of the amusement game machine 12 or above a subjacent conveyor support plate. Another nut 46 on each threaded rod 44 is tightened into engagement with a top surface of a conveyor support plate 42 to hold the plate down firmly against the lower nut.

Figure 3:
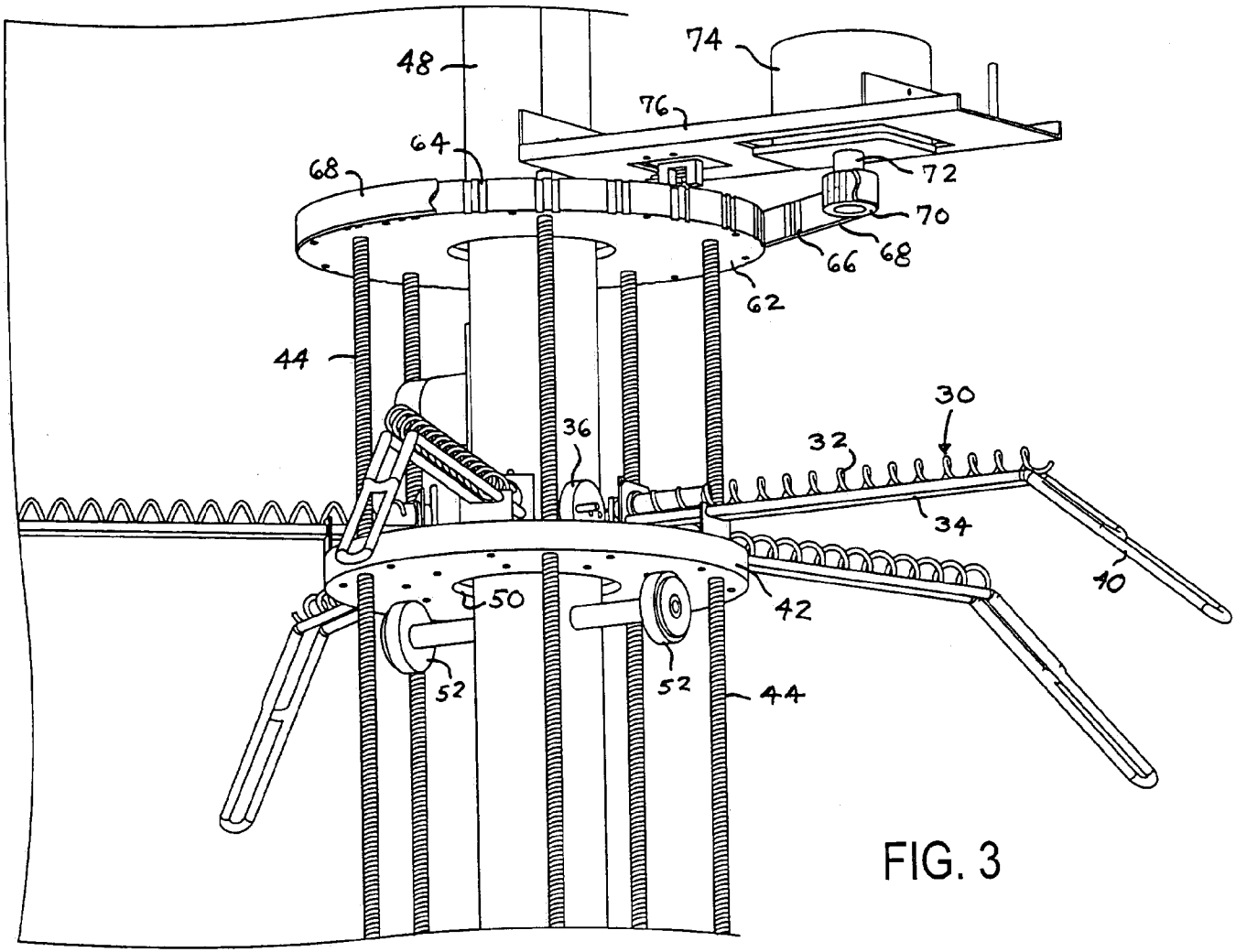
FIG. 3 is an enlarged isometric view of a top portion of the vend mechanism of FIG. 2.

As can be seen from FIG. 3, the assembly of threaded rods 44 and conveyor support plates 42 is positioned around a central post 48, the support plates having central openings 50 to accommodate the post. The central post 48 is fixed in the cabinet of the machine 12. Support rollers 52 are mounted on the post 48 to engage the underside of a conveyor support plate 42 and thereby support the conveyor moving arrangement for rotation about the post. An arrangement of the rollers 52 for one conveyor support plate 42 is sufficient because all support plates are connected. However, support rollers 52 for each conveyor plate can be provided if desired.

Figure 4:
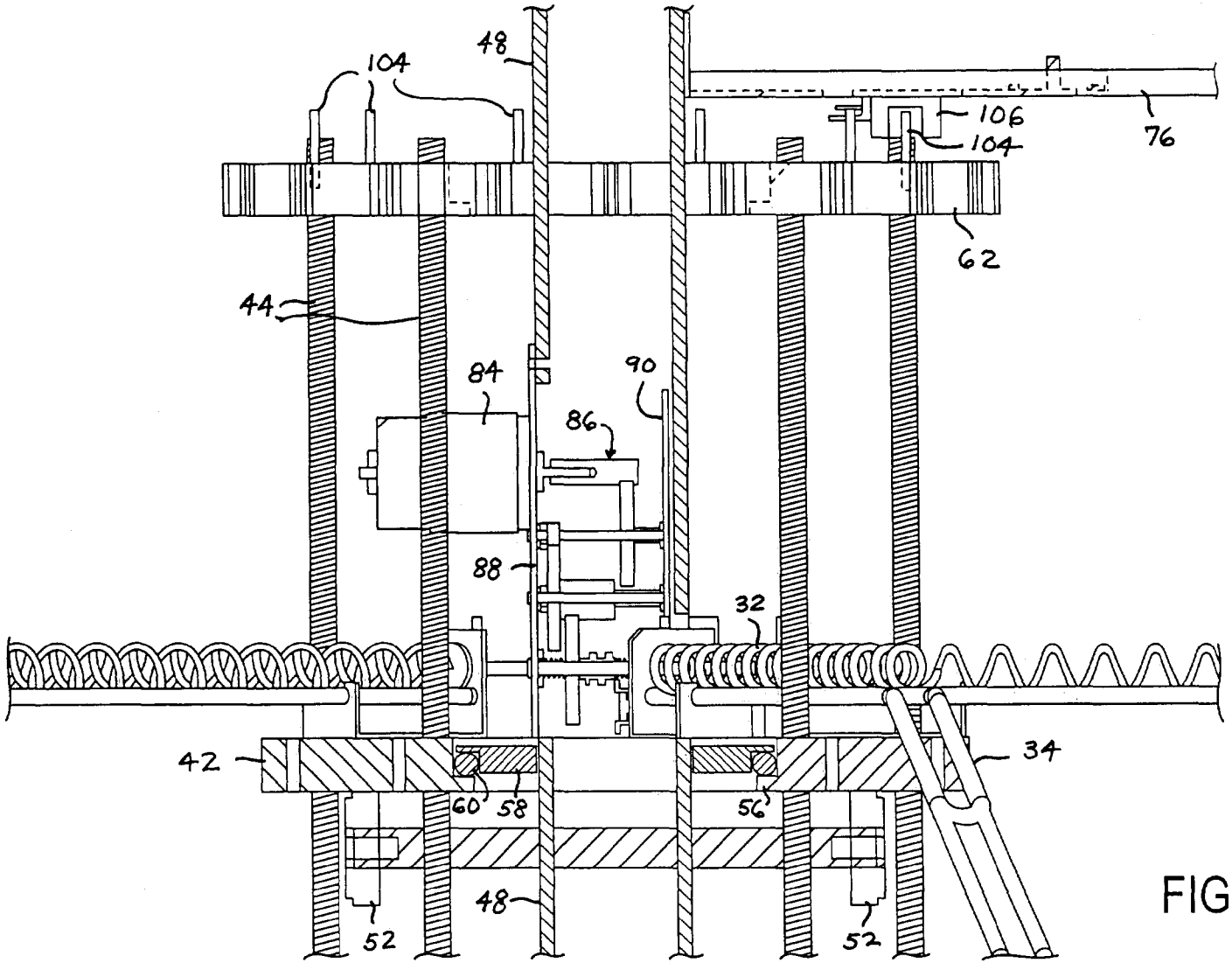
FIG. 4 is an enlarged elevation of a portion of the vend mechanism of FIG. 2.

As can be seen from FIG. 4, a bearing arrangement 54 is provided in at least one of the conveyor support plates 42 to center the conveyor moving arrangement around the post and smoothly guide the rotation of the conveyor moving arrangement around the post. In the illustrated embodiment, a shoulder 56 is provided at the opening 50 through the support plate to define an outer race for a bearing. An inner race member 58 is secured to the post 48, such as by keying, and a plurality of bearing elements, such as balls 60, are positioned between the two races.

As can be seen from FIG. 3, the upper ends of the threaded rods 44 are secured in an apertured plate 62, or timing gear. The upper plate 62 has regularly spaced notches 64 to engage complementary-shaped ribs 66 on a timing belt 68 driven by a notched driving element 70 secured to the shaft 72 of an electric motor 74, such as a stepper motor. The electric motor 74 is mounted on a bracket 76 secured at one end to the post 48. In response to an electrical signal, the motor 74, through the driving element 70, the timing belt 68 and the notched upper plate 62, rotates the conveyor moving arrangement precisely through a desired angle such that one of the conveyors 30 on each conveyor support plate 42 is in a position to transfer an article 14 to the receiving area of the machine 12. In the illustrated example, one conveyor 30 on each conveyor support plate 42 is positioned vertically above the receiving area, so that, upon operation of the helical element 32, the article 14 falls from the outer end of the conveyor and into the receiving area.

Figure 6:
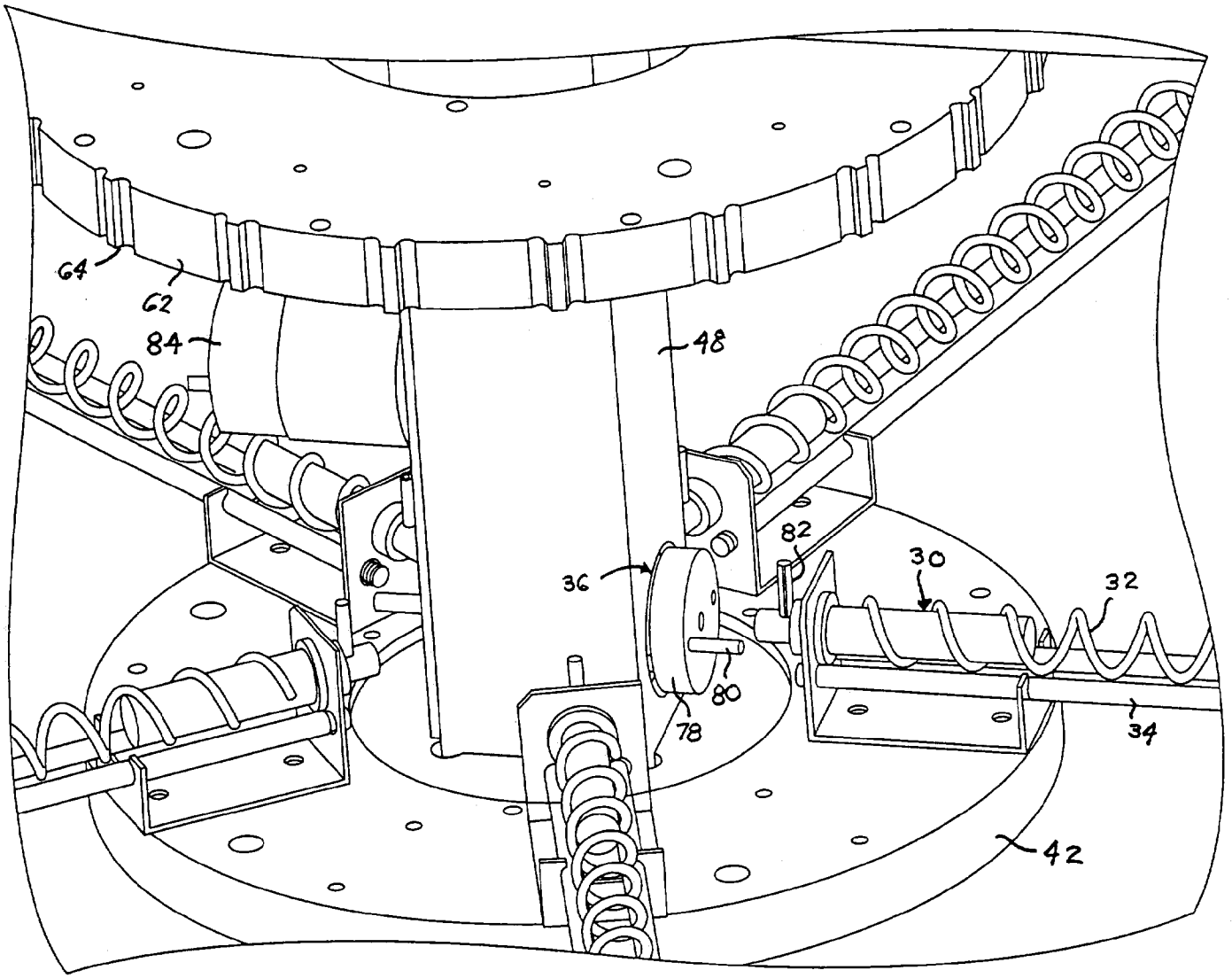
FIG. 6 is an enlarged isometric view of a top portion of the vend mechanism of FIG. 2, showing an extendable drive element for the conveyors.
Figure 7:
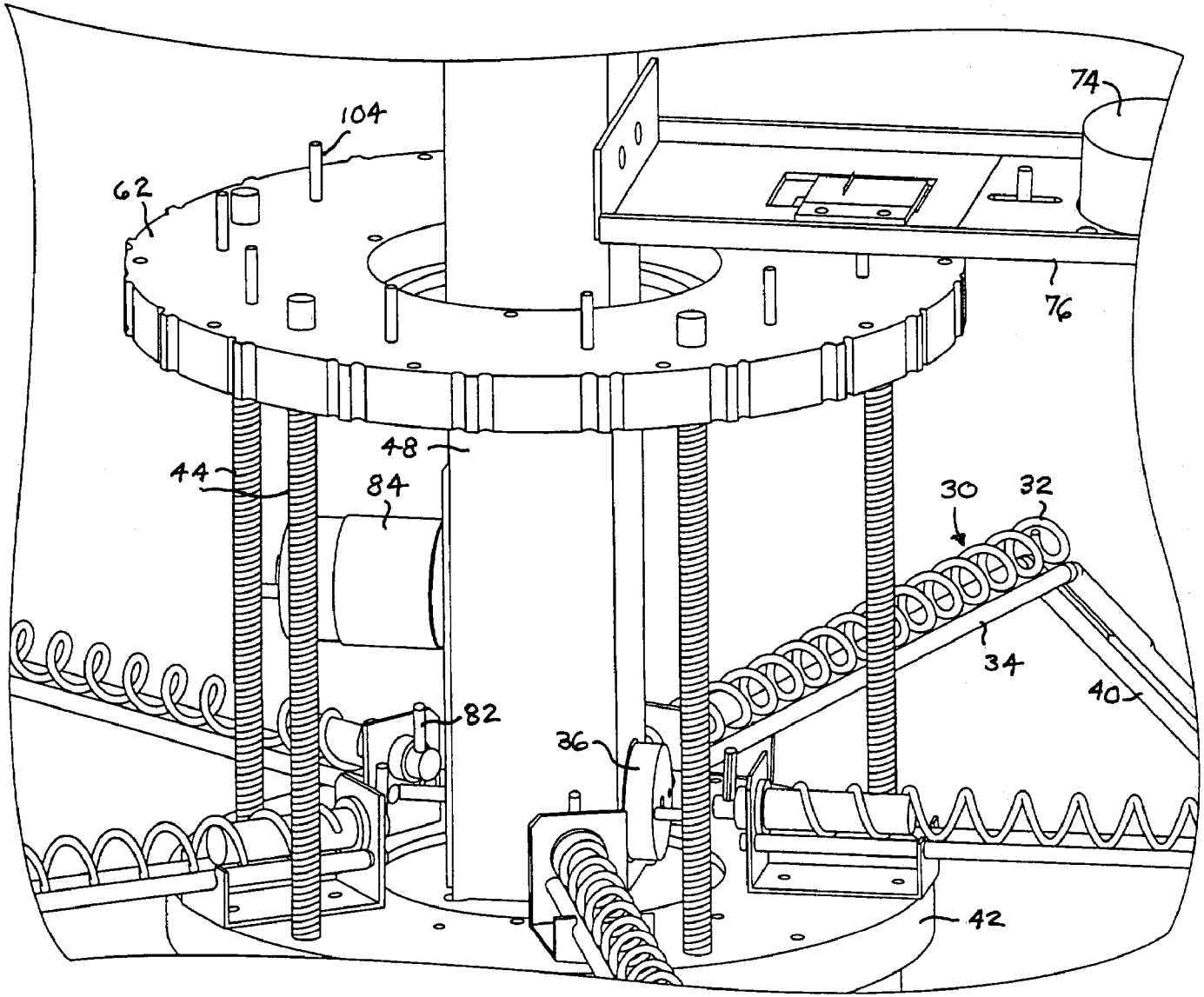
FIG. 7 is another enlarged isometric view of a top portion of the vend mechanism of FIG. 2 showing pins for detection by an optical sensor.
Figure 9:
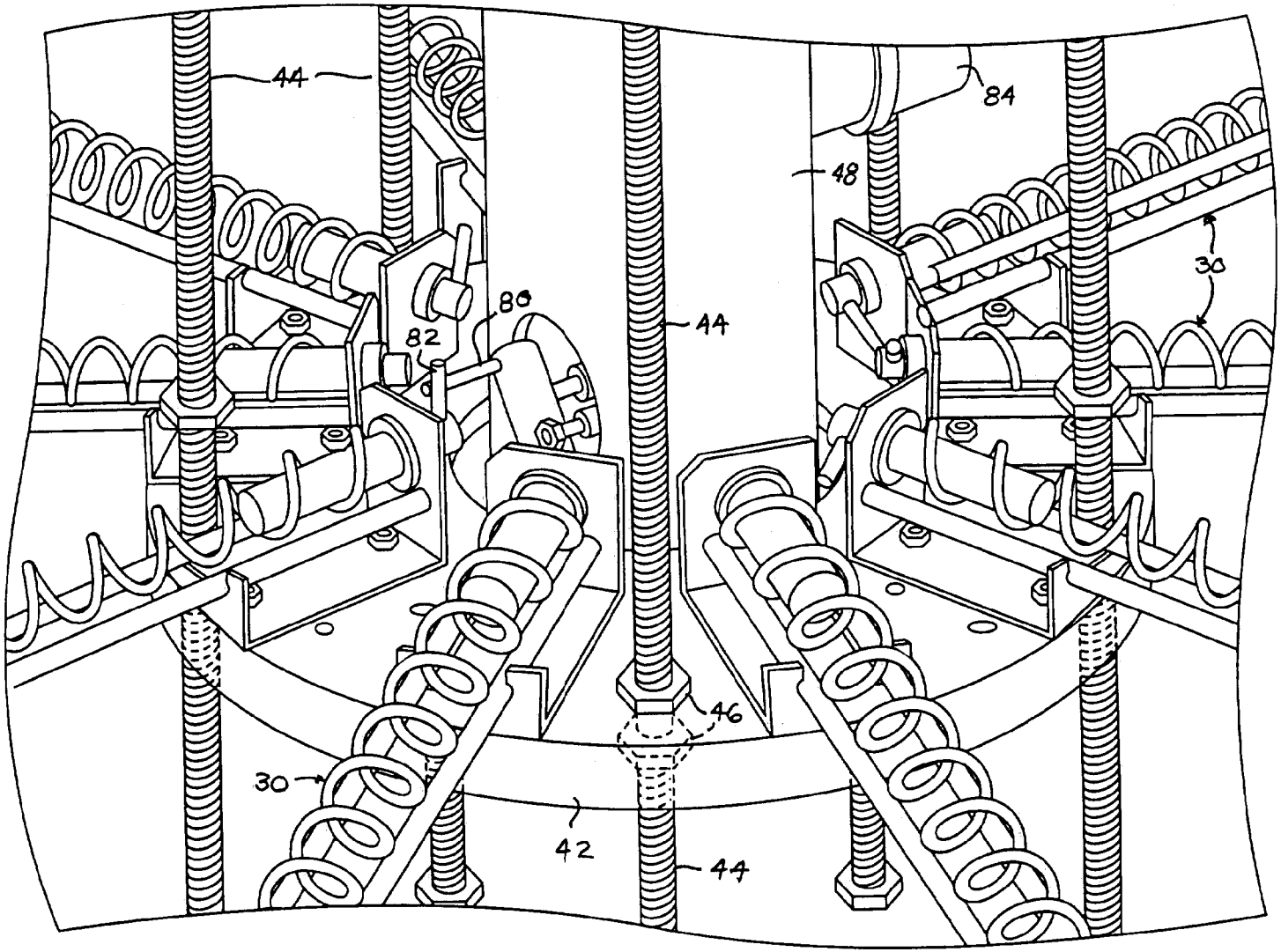
FIG. 9 is a view similar to FIG. 8, but showing the drive element in engagement with a juxtapose conveyor.

At each conveyor support plate 42, the conveyor 30 that is in the article transferring orientation has an inner end adjacent to a conveyor operator 36. The conveyor operator 36 has a drive element 78 movable between a retracted position, as is shown in FIGS. 6–8, in which the drive element is out of engagement from the conveyor 30, and an extended position as shown in FIG. 9, in which the drive element is in driving engagement with the conveyor. In the illustrated embodiment, the drive element 78 has a pin 80 extending parallel to the longitudinal axis of the conveyor 30, and the conveyor has a pin 82 extending transversely from its longitudinal axis. In the extended position, the pin 80 of the drive element 78 engages the pin 82 of the conveyor 30 and, upon rotation of the drive element, moves the pin 80 of the conveyor and the helical element 32 through the desired angle of rotation.

Figure 10:
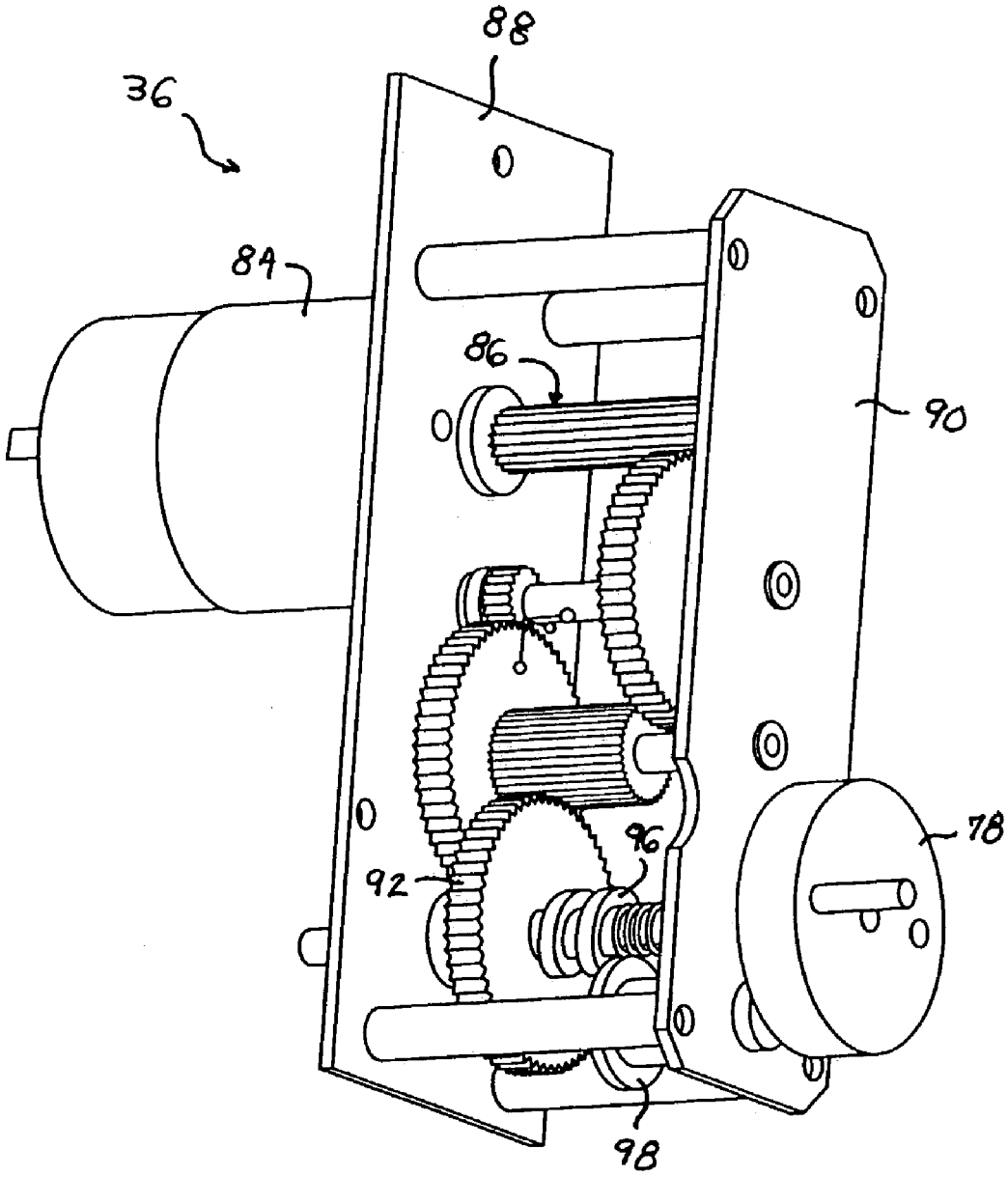
FIG. 10 is an isometric view of a conveyor operator in accordance with the present invention, with the drive element in a retracted position.
Figure 11:
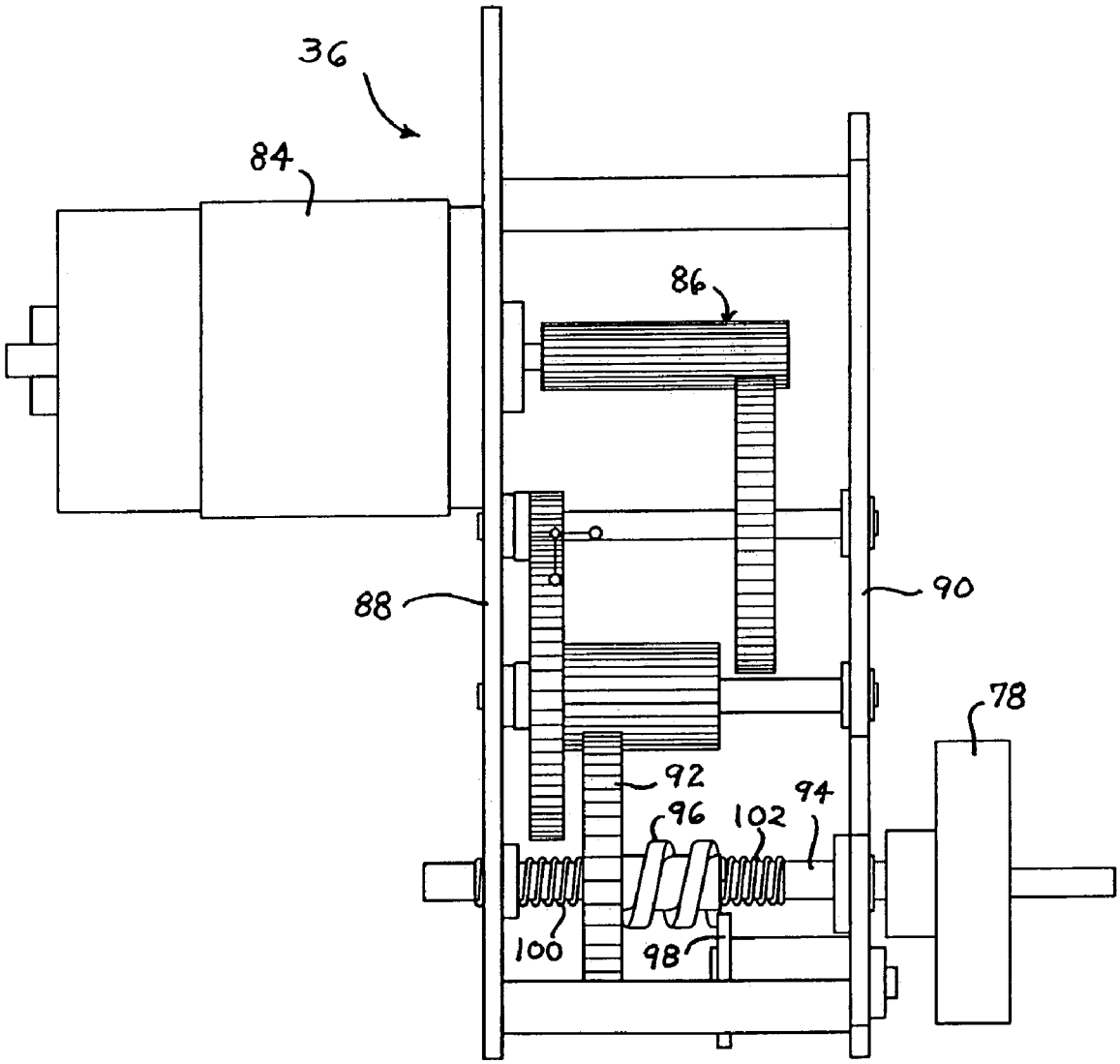
FIG. 11 is a front elevation of the drive operator of FIG. 10.
Figure 12:
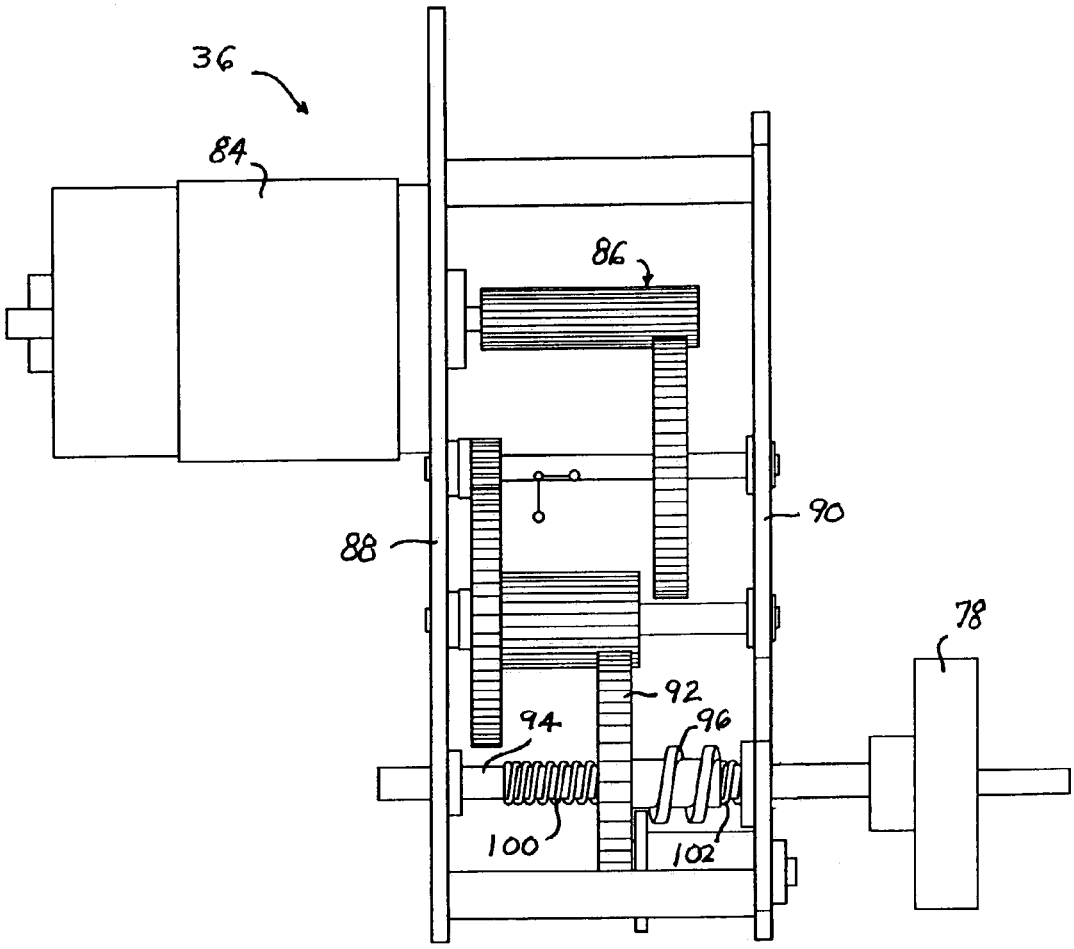
FIG. 12 is a front elevation of the drive arrangement of FIG. 10, with the drive element in an extended position.

As can be seen from FIGS. 10–12, the conveyor operator 36 is a drive arrangement that includes an electric motor 84, such as a DC or stepper motor, and a speed-reducing gear train 86, including a mechanism for extending and retracting the drive element. The drive train 86 is mounted on and positioned between spaced parallel plates 88 and 90, with the drive element 78 being positioned outside the space between the plates. The gear train 86 includes a gear 92 fixed to a final gear shaft 94 on which a linear drive gear in the form of a spiral element 96 is positioned. The spiral element 96 engages a fixed member 98 which is received between adjacent convolutions of the spiral element. First and second compression springs 100 and 102 are provided to assist in maintaining the spiral element 96 in engagement with the fixed member 98. The spring 100 maintains pressure on the spiral element 96 in the forward, or extending, direction. The spring 102 maintains pressure on the spiral element 96 in the rearward, or retracting, direction. Each spring 100, 102 is long enough to bias the spiral element 96 into engagement with the fixed member 98, but short enough not to oppose the biasing of the other spring 102, 100. In FIG. 11, the drive element 78 is shown in its retracted position, and one end of the spiral element 96 engages the fixed member 98. Upon activation of the drive arrangement, the gear 92 rotates, and the gear shaft 94 and the spiral element 96 rotate with it. As a result of the engagement between the spiral element 96 and the fixed member 98, the spiral element moves axially toward the right in FIG. 11, thereby extending the drive element 78. When the entire spiral element 96 has moved to the right of the fixed member, extension of the drive element 78 stops, but rotation continues until stopped by a timer or other arrangement. The extended position is shown in FIG. 12. The timer or other arrangement also begins the reverse rotation of the motor 84, which causes movement of the spiral element 96 and the drive element 78 to the left, which is the retracted position. When the entire spiral element 96 moves back to the left of the fixed member 98, the spiral element 96, the gear shaft 94 and the drive element 78 maintain their retracted positions until the timer stops the motor 84. The overall length of the spiral element 96 determines the travel of the gear shaft 94 and the drive element 78. A plurality of drive arrangements is provided, one drive arrangement for each plane of conveyor 30.

As can best be seen from FIG. 4, pins 104, or flags, are provided on the timing gear, one pin in vertical alignment with each column of conveyors. As the apertured plate 62, or timing gear, rotates, the pins 104 pass in series by an optical sensor 106, so that the optical sensor detects the rotational positions of the pins and, thereby, the rotational positions of the columns of conveyors 30.

In addition to the vend mechanism just described, and as can be seen in FIG. 1, the amusement game or vending machine 12 can also provide storage compartments 108 for containing and displaying articles or prizes 110. For example, in the illustrated embodiment, the compartments 108 are situated at the top of the machine 12, each compartment 108 having a hinged transparent door 112 with a knob 114 to enable the door to be opened. The doors 112 are normally maintained in a locked condition by a lock mechanism, such as a solenoid-operated latch, which can be activated in response to the achievement of a predetermined level of success in the game 16 or, in the case of a money-operated vending machine, in response to payment of a predetermined amount. Upon the appropriate signal, the lock mechanism is actuated to allow a selected door 112 to be opened and the contents of the associated compartment 108 removed.

In operation, in response to success in the game 16 or the payment of the appropriate amount of money, a person selects the desired article 14 by rotating the conveyor moving arrangement until the desired article is in the position in which operation of the conveyor 30 having the article will cause the article to fall into the area accessible from the exterior. This is done by pressing a button 116, which rotates the conveyor moving arrangement incrementally. Each increment equals the angle between the conveyors. Each increment locates several conveyors, aligned vertically, into the selection position. Once the desired item is rotated into the selection position by the motor, the person presses another button, one of a group of buttons, which defines the vertical position of the item. There is one of the group of buttons for each prize that is located in the selection position. The motor corresponding to that vertical item position operates the merchandise screw, driving the item off of the conveyor, and vending the prize. There is a sensor located in the prize drop area to verify a successful vend. When the sensor detects the item, the motor is immediately reversed for a timed period, disengaging the drive element from the conveyor before the next prize on the same conveyor is vended.

Figure 13:
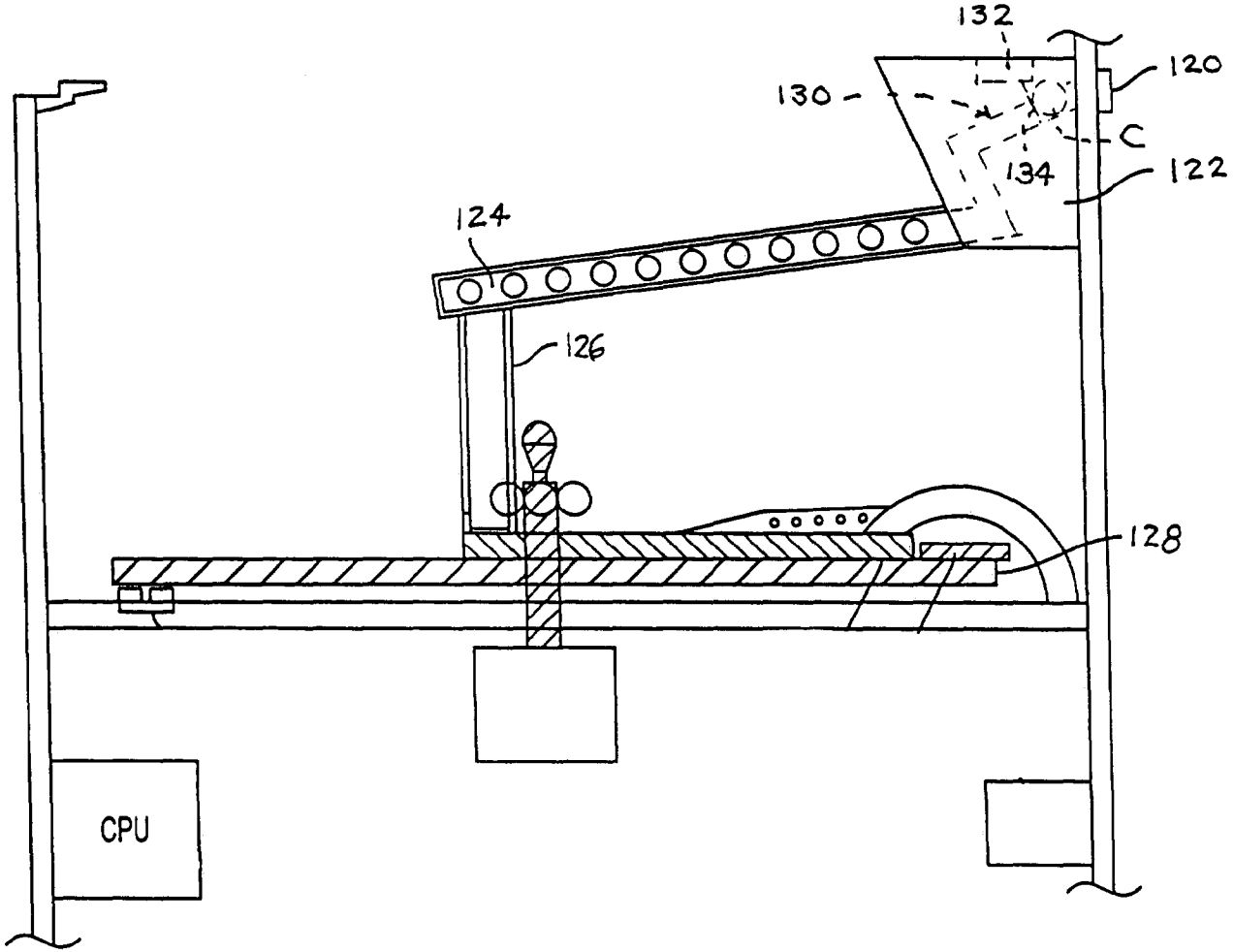
FIG. 13 is a schematic front elevation, with parts in cross section, of one form of a game mechanism with which the vend mechanism of the present invention can be used.

As can seen from FIG. 13, details of the game mechanism 16 disclosed in Ser. No. 10/152,571 are shown, including a coin slot 120 associated with a coin mechanism 122 that guides coins to successive chutes 124 and 126 that deposit the coins on a rotating table 128. Players can score points if the coins come to rest on predetermined point areas of the wheel. In one embodiment of the game mechanism 16, players can time the insertion of coins into the slot 120 in an effort to cause the coins to come to rest in a point area. In order to remove the skill element and make the deposit of the coins on the wheel 128 random, a coin escrow mechanism 130 can be provided in the coin mechanism 122, as is indicated by the dashed lines in FIG. 13. The coin escrow mechanism can include, for example, a solenoid 132 having a detent arm 134 movable from a position shown in FIG. 13, in which the arm stops and holds a coin C, to a position in which the arm moves out of the path of the coin, thereby permitting the coin to continue on a guide path for deposit on the rotating table 128. The detent arm 134 can move in response to a timer from the position shown in FIG. 13 to the position enabling the coin to continue.

It will be apparent to those skilled in the art and it is contemplated that variations and/or changes in the embodiments illustrated and described herein may be made without departure from the present invention. Accordingly, it is intended that the foregoing description is illustrative only, not limiting, and that the true spirit and scope of the present invention will be determined by the appended claims.

What is claimed is:

1. A vend mechanism for transferring articles to a receiving area of a vending machine, comprising:

a conveyor assembly having a plurality of conveyors for conveying said articles in a substantially lateral direction and transferring said articles to said receiving area;

a conveyor operator engine, for driving the conveyers, and a conveyor assembly orientation engine for moving said assembly so that at least one of said conveyors in said conveyor assembly is in a transferring orientation in which operation of one of said conveyors transfers one of said articles to said receiving area wherein said conveyors in said conveyor assembly are oriented at angular positions about a central axis.

2. The vend mechanism of claim 1, wherein each said conveyor has a central longitudinal axis and, in moving at least one of said conveyors to the transferring orientation, the conveyor assembly orientation engine changes the angular orientation of said conveyor on said longitudinal axis.

3. The vend mechanism of claim 2, wherein each said conveyor further comprises a helical element rotatable about a rotational axis parallel to the longitudinal axis of the conveyor.

4. The vend mechanism of claim 3, wherein a plurality of articles are positioned on each said conveyor, and said conveyor operator engine comprises an arrangement for rotating the helical element through an angle at which only one of the articles is transferred to said receiving area from said conveyor.

5. The vend mechanism of claim 3, wherein the conveyor operator engine comprises a drive arrangement having a drive element movable between a retracted position, in which the drive element is out of engagement from the conveyor, and an extended position, in which the drive element is in driving engagement with the conveyor.

6. The vend mechanism of claim 5, wherein the drive arrangement also has a rotating shaft fixed to the drive element, the rotating shaft bearing a helical structure, and a fixed member engaging the helical structure whereby the rotating shaft moves parallel to its axis in response to rotation about its axis.

7. The vend mechanism of claim 1, wherein said conveyor assembly orientation engine moves any selected one of the conveyor assemblies to a transferring orientation in which operation of the selected conveyor transfers one of the articles to a receiving area.

8. The vend mechanism of claim 7, wherein each of the conveyors in said conveyor assembly has a longitudinal axis, the longitudinal axes all lying in a conveyor assembly plane, and the conveyor assembly orientation engine moves the conveyors such that the longitudinal axes of the conveyors move about an axis perpendicular to said conveyor assembly plane.

9. The vend mechanism of claim 8, wherein said conveyor assembly further comprises a conveyor support plate and said convevors are mounted on said conveyor support plate.

10. The vend mechanism of claim 9 further comprising a bearing structure guiding the conveyor support plate for movement about said axis perpendicular to said conveyor assembly plane.

11. The vend mechanism of claim 8, wherein the conveyor assembly orientation engine further comprises a drive arrangement rotating a conveyor support plate through a selected angle about said axis perpendicular to the conveyor assembly plane.

12. The vend mechanism of claim 8, furthers comprising a drive arrangement having a drive element, wherein the conveyor assembly orientation engine moves one of the conveyors into juxtaposition with the drive element, and the drive element is movable between a retracted position, in which the drive element is out of engagement from the conveyors, and an extended position in which the drive element is in engagement with said one conveyor.

13. The vend mechanism of claim 1, further comprising a plurality of conveyor assembly planes and the conveyor assembly orientation engine moves the conveyors such that the longitudinal axes of the conveyors move about an axis perpendicular to the conveyor assembly planes.

14. The vend mechanism of claim 13, wherein said conveyor assembly planes are arranged one above another, and the conveyors in each said conveyor assembly each have a length, the length of the conveyor of one conveyor assembly plane being greater than the length of the conveyors of a conveyor assembly plane below said one conveyor assembly plane.

15. The vend mechanism of claim 13, wherein said conveyors are mounted on a plurality of conveyor support plates, the support plates being fixed at a distance from one another, and the conveyor operator engine having a driving arrangement moveable between a retracted position, in which the drive element is out of engagement from the conveyor, and an extended position, in which the drive element is in driving engagement with the conveyor.

16. The vend mechanism of claim 15 further comprising a bearing structure guiding the conveyor support plates for movement about said axis perpendicular to the conveyor assembly plane.

17. The vend mechanism of claim 13, wherein the conveyor assembly orientation engine comprises a drive arrangement for rotating the conveyor support plates through a selected angle about said axis perpendicular to the conveyor assembly plane.

* * * * *